US006680563B2

(12) United States Patent
Reed et al.

(10) Patent No.: US 6,680,563 B2
(45) Date of Patent: Jan. 20, 2004

(54) COLOR PICTURE TUBE HAVING A LOW EXPANSION TENSION MASK ATTACHED TO A HIGHER EXPANSION FRAME

(75) Inventors: Joseph Arthur Reed, York, PA (US); Gary Lee Diven, Lancaster, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 156 days.

(21) Appl. No.: 09/893,115

(22) Filed: Jun. 27, 2001

(65) Prior Publication Data

US 2003/0001484 A1 Jan. 2, 2003

(51) Int. Cl.[7] ..... H01J 29/80
(52) U.S. Cl. ..... 313/407
(58) Field of Search ..... 313/402, 407, 313/408

(56) References Cited

U.S. PATENT DOCUMENTS 4,437,036 A * 3/1984 Ragland, Jr. ..... 313/402
4,739,216 A * 4/1988 Yamazaki et al. ..... 313/407
5,336,962 A 8/1994 Keller ..... 313/402
5,594,300 A 1/1997 Nosker et al. ..... 313/402
5,644,192 A 7/1997 Ragland, Jr. ..... 313/402
5,952,774 A 9/1999 Diven et al. ..... 313/402
6,084,342 A 7/2000 Ragland, Jr. ..... 313/407
6,225,736 B1 5/2001 Gorog ..... 313/407

* cited by examiner

*Primary Examiner*—Sandra O'Shea
*Assistant Examiner*—Sumati Krishnan
(74) *Attorney, Agent, or Firm*—Joseph S. Tripoli; Carlos M. Herrera; Patricia A. Verlangieri

(57) ABSTRACT

A color picture tube (10) has a tensioned mask (24) supported by a support frame (28) mounted within the tube. The mask has a significantly lower coefficient of thermal expansion than the frame. Intermediate members (48) are located between the mask and the frame. The intermediate members are of a material having a coefficient of thermal expansion similar to that of the mask. The frame has elongated tabs (46) extending therefrom. Each of the tabs is attached at one end thereof to the remaining portion of the frame. The distal ends of the tabs are welded to the intermediate members.

19 Claims, 4 Drawing Sheets

COLOR PICTURE TUBE HAVING A LOW EXPANSION TENSION MASK ATTACHED TO A HIGHER EXPANSION FRAME

This invention relates to color picture tubes having tension masks, and particularly to a tube having means for connecting a tension mask, that is made of a material having a relatively low coefficient of thermal expansion material, to a support frame, that has a significantly higher coefficient of thermal expansion.

BACKGROUND OF THE INVENTION

A color picture tube includes an electron gun for generating and directing three electron beams to the screen of the tube. The screen is located on the inner surface of a faceplate of the tube and is made up of an array of elements of three different color-emitting phosphors. A color selection electrode, which may be either a shadow mask or a focus mask, is interposed between the gun and the screen to permit each electron beam to strike only the phosphor elements associated with that beam. A shadow mask is a thin sheet of metal, such as steel, that is usually contoured to somewhat parallel the inner surface of the tube faceplate.

One type of color picture tube has a tension mask mounted within a faceplate panel thereof. In order to maintain the tension on the mask, the mask must be attached to a relatively massive support frame. Although such tubes have found wide consumer acceptance, there is still a need for further improvement, to reduce the weight and cost of the mask-frame assemblies in such tubes.

It has been suggested that a lighter frame could be used in a tension mask tube if the required tension on a mask is reduced. One way to reduce the required mask tension is to make the mask from a material having a low coefficient of thermal expansion. However, a mask from such material requires a support frame of a material having a similar coefficient of thermal expansion, to prevent any mismatch of expansions during thermal processing that is required for tube manufacturing, and during tube operation. Because the metal materials that have low coefficients of thermal expansion are relatively expensive, it is costly to make both the mask and frame out of identical or similar low expansion materials. Therefore, it is desirable to use the combination of a low expansion tension mask with a higher expansion support frame, and to provide a solution to the problem that exists when there is a substantial mismatch in coefficients of thermal expansion between a tension mask and its support frame.

SUMMARY OF THE INVENTION

The present invention provides an improvement in a color picture tube having a tensioned mask supported by a support frame mounted within the tube. The mask has a significantly lower coefficient of thermal expansion than the frame. Intermediate members are located between the mask and the frame. The intermediate members are of a material having a coefficient of thermal expansion similar to that of the mask. The frame has elongated tabs extending therefrom. Each of the tabs is attached at one end thereof to the remaining portion of the frame. The distal ends of at least some of the tabs are welded to the intermediate members.

DETAILED DESCRIPTION OF THE PREFERRED EMBODIMENTS

Figure 1:
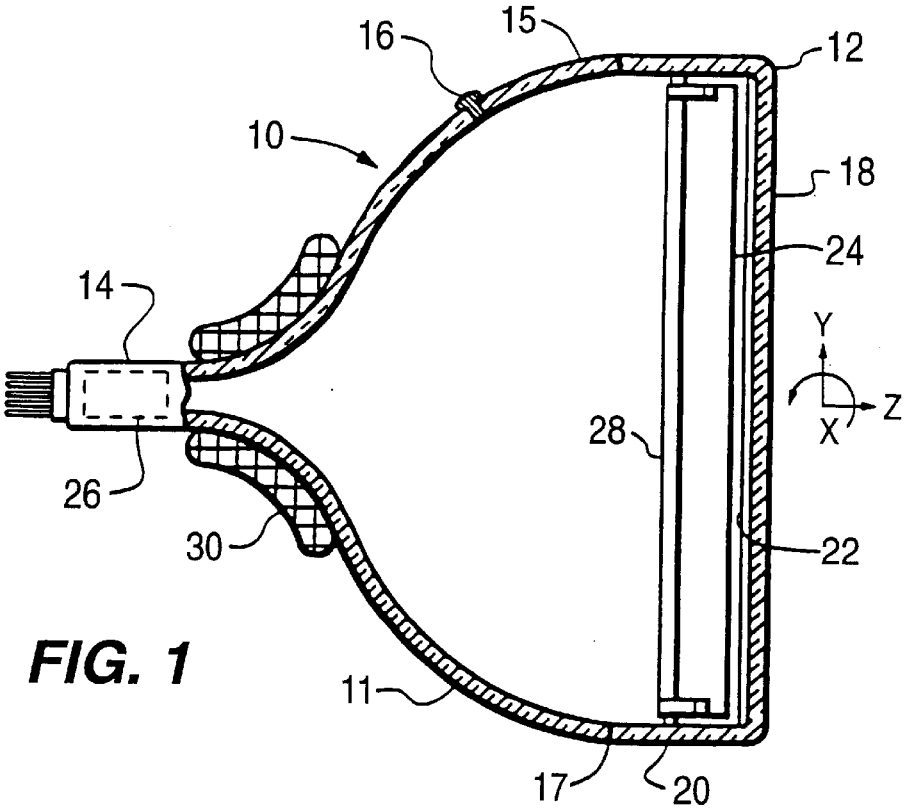
FIG. 1 is a side view, partly in axial section, of a color picture tube embodying the invention.

FIG. 1 shows a color picture tube 10 having a glass envelope 11 comprising a rectangular faceplate panel 12 and a tubular neck 14 connected by a funnel 15. The funnel 15 has an internal conductive coating (not shown) that extends from an anode button 16 toward the panel 12 and to the neck 14. The panel 12 comprises a substantially cylindrical or flat viewing faceplate 18 and a peripheral flange or sidewall 20, which is sealed to the funnel 15 by a glass frit 17. A three-color phosphor screen 22 is carried by the inner surface of the faceplate 18. The screen 22 is a line screen with the phosphor lines arranged in triads, each triad including a phosphor line of each of the three colors. A color selection tension mask 24 is removably mounted in predetermined spaced relation to the screen 22. An electron gun 26, shown schematically by dashed lines in FIG. 1, is centrally mounted within the neck 14 to generate and direct three inline electron beams, a center beam and two side or outer beams, along convergent paths through the mask 24 to the screen 22.

The tube 10 is designed to be used with an external magnetic deflection yoke, such as the yoke 30 shown in the neighborhood of the funnel-to-neck junction. When activated, the yoke 30 subjects the three beams to magnetic fields which cause the beams to scan horizontally and vertically in a rectangular raster over the screen 22.

Figure 2:
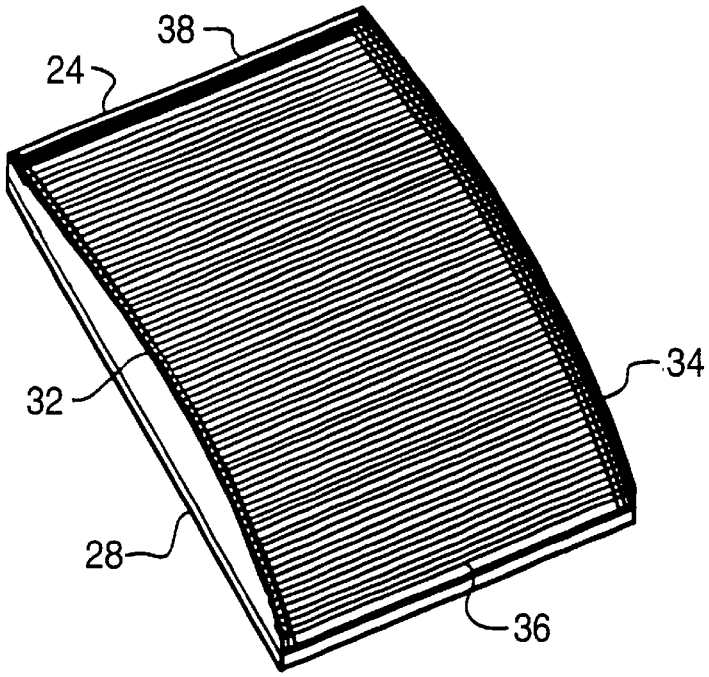
FIG. 2 is a perspective view of a tension mask-frame assembly.

The tension mask 24, as shown in FIG. 2, is attached to a peripheral frame 28 that includes two long sides 32 and 34, and two short sides 36 and 38. The two long sides 32 and 34 of the frame parallel a central major axis, X, of the tube; and the two short sides 36 and 38 parallel a central minor axis, Y, of the tube. The tension mask 24 includes an apertured portion that contains a plurality of metal strips having a multiplicity of elongated slits therebetween that parallel the minor axis of the mask.

Figure 3:
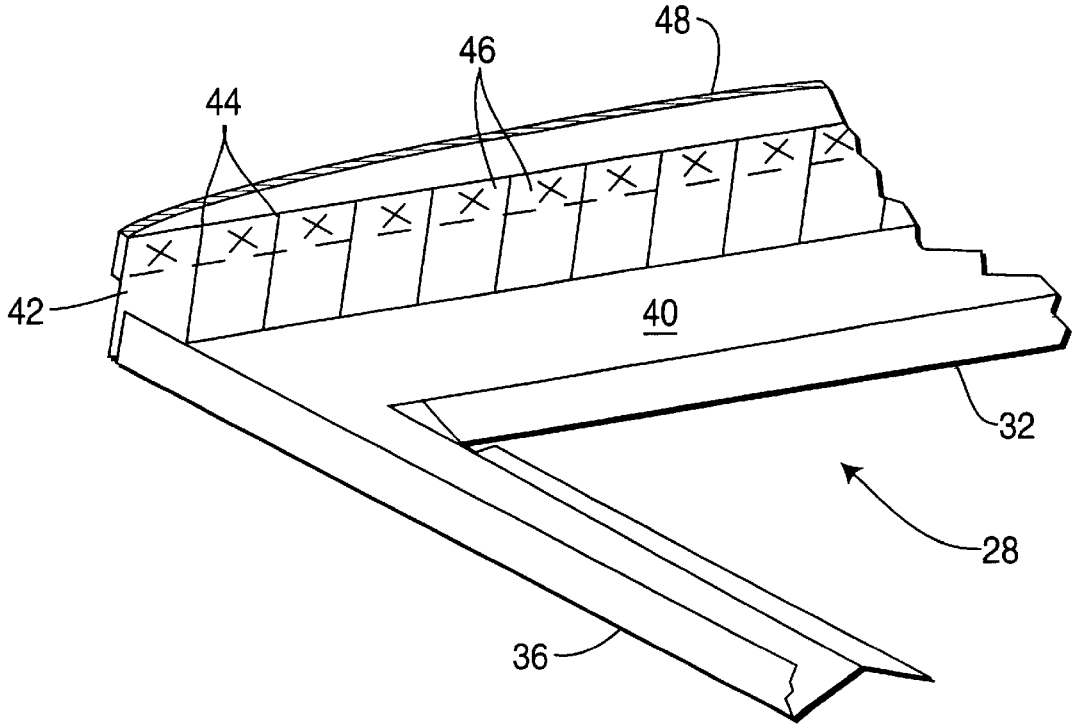
FIG. 3 is a partial perspective view of the frame of FIG. 2.

Details of the frame 28 are shown in FIG. 3. The long sides of the frame 32 and 34 have an L-shaped cross-section formed by two flanges 40 and 42. One flange 40 is in the X-Y plane, perpendicular to the central longitudinal Z axis of the tube. The second flange 42 is in the X-Z plane, extending perpendicularly to the Y axis. The short sides 36 and 38 also have an L-shaped cross-section, but could be shaped in other cross-sections, such as square, rectangular or even solid. The second flange 42 includes a plurality of slits 44 therein that extend from near the proximal end connection with the first flange 40 to the distal edge of the second flange. The slits 44 define a series of tabs 46 in the frame 28. In this embodiment, each of the tabs 46 is welded near its distal end to an intermediate member 48. In other embodiments, the intermediate members 48 need not be attached to all of the tabs 46. Each intermediate member 48 extends the length of a long side, 32 and 34, and overlaps the second flange 42 that includes the tabs 46. The mask 24, as shown in FIG. 2, is attached between the distal edges of two parallel intermediate members 48, that are attached to the two long sides 32 and 34 of the frame 28. The intermediate members 48 are of a material that has a low coefficient of thermal expansion, similar to that of the mask 24. Therefore, expansion mismatch between the mask and the frame, caused by changes in temperature, does not occur and mask wrinkling during tube manufacturing and mask/frame warping during tube operation do not occur.

In one embodiment, the L-shaped frame is made from 4130 steel, and the intermediate members and mask are made of low expansion materials, such as nickel iron alloy (INVAR). The L-shaped frame is 1.27 mm (0.050") thick, and the intermediate members 48 are 3.05 mm (0.120") thick. In general, thicknesses of the component parts of the complete frame assembly are determined by considering mask thickness, the flexibility of the total mask-frame assembly and the desired warp misregistration limits.

Further embodiments are shown in FIGS. 4 through 9. Each of the embodiments utilizes two intermediate members, that are either the same or similar to the members 48 used in the first embodiment.

Figure 4:
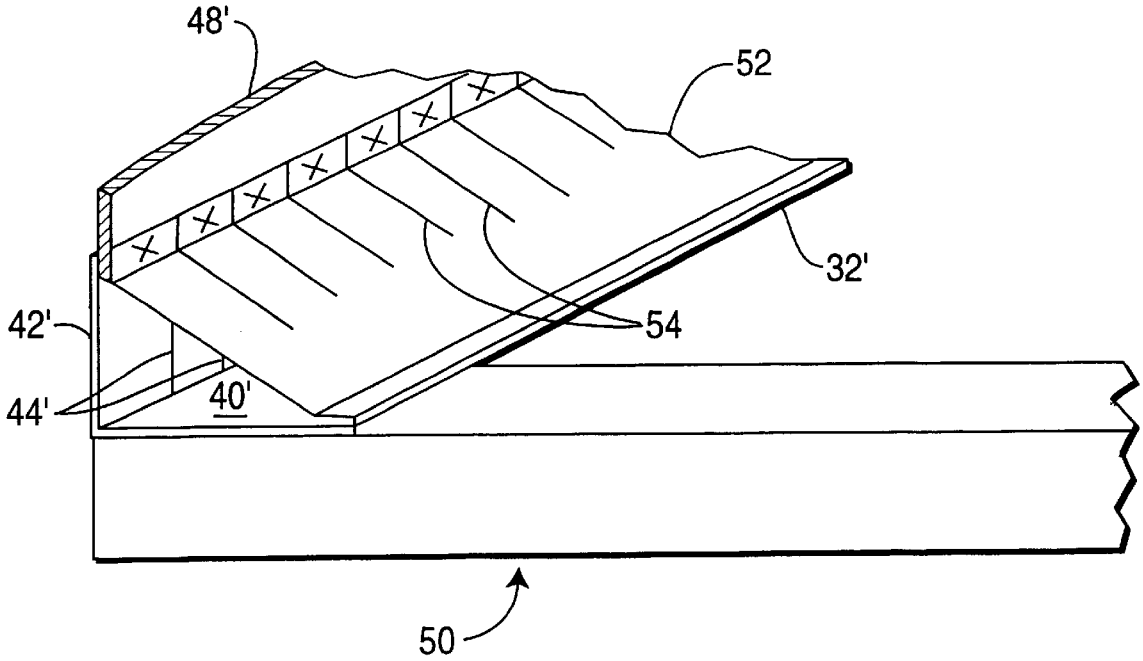
FIG. 4 is a partial perspective view of a second frame embodiment.

The frame 50 of FIG. 4 is similar to the frame 28 of FIG. 3, except that along each long side 32' an angled portion 52 extends between two flanges 40' and 42' to form a triangularly shaped cross-section. The angled portion 52 includes a plurality of slits 54 that are aligned with slits 44' in the second flange 42' An intermediate member 48' is located between the flange 42' and the angled portion 52. The formation of a triangular cross-section provides for a rigid frame, even with thinner material than that required for the frame 28 of FIG. 3.

Figure 5:
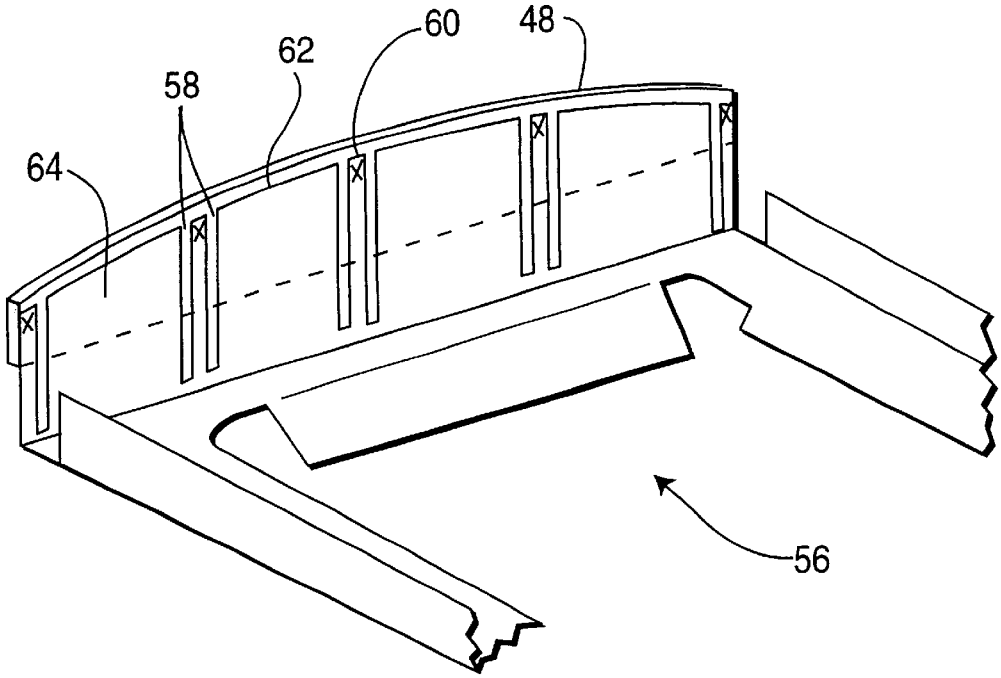
FIG. 5 is a partial perspective view of a third frame embodiment.
Figure 6:
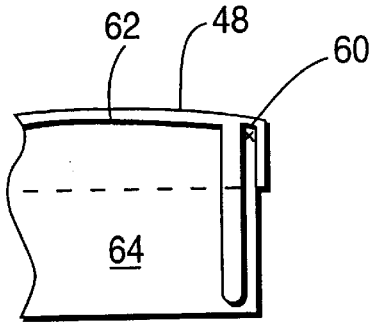
FIGS. 6 and 7 are elevation views of the right end of the frame of FIG. 5 in an unheated condition and in a heated condition, respectively.
Figure 7:
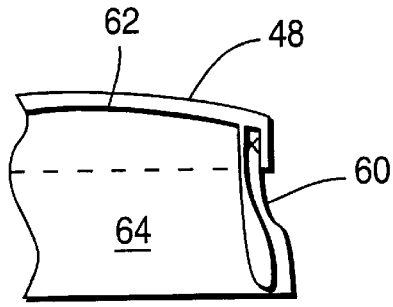

FIG. 5 shows a frame 56 that includes slits 58 having varied spacings to form narrower and wider sections, 60 and 62, respectively, in a second flange 64. The narrower sections 60 are the tabs to which the intermediate member 48 is attached. FIGS. 6 and 7 show the end tab of the frame 56 of FIG. 5, in an unheated condition and in a heated condition, respectively. When the frame is heated, it expands more than does the intermediate member 48. Compensation for this expansion differential, to maintain the position of the intermediate member 48, is provided by the flexure of the tab.

Figure 8:
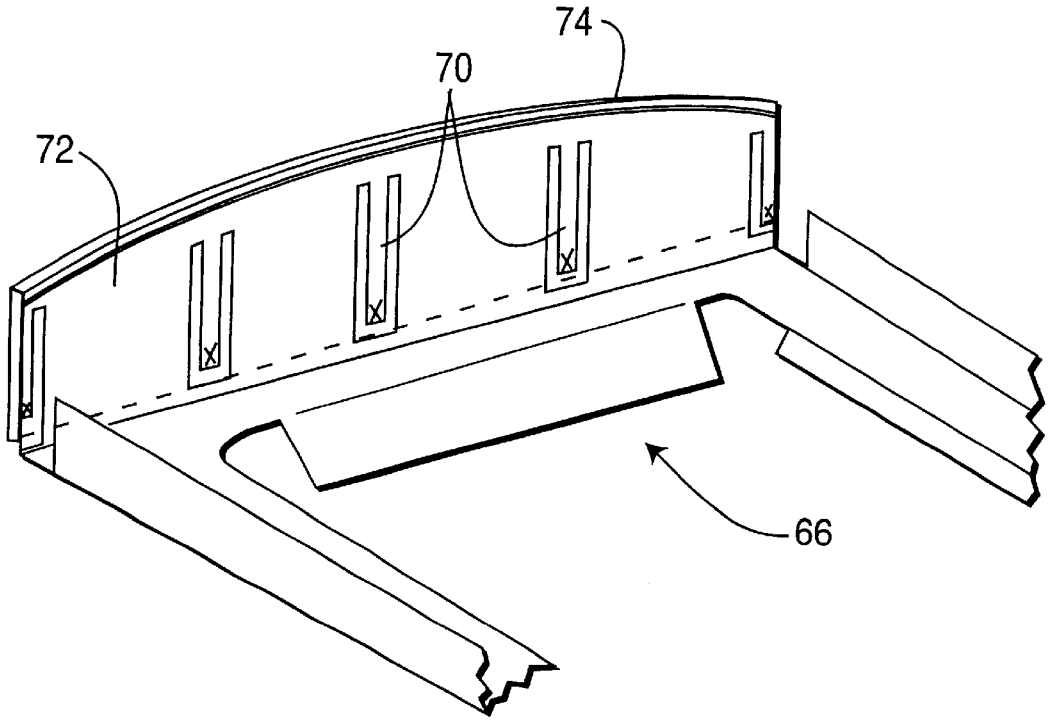
FIG. 8 is a partial perspective view of a fourth frame embodiment.
Figure 9:
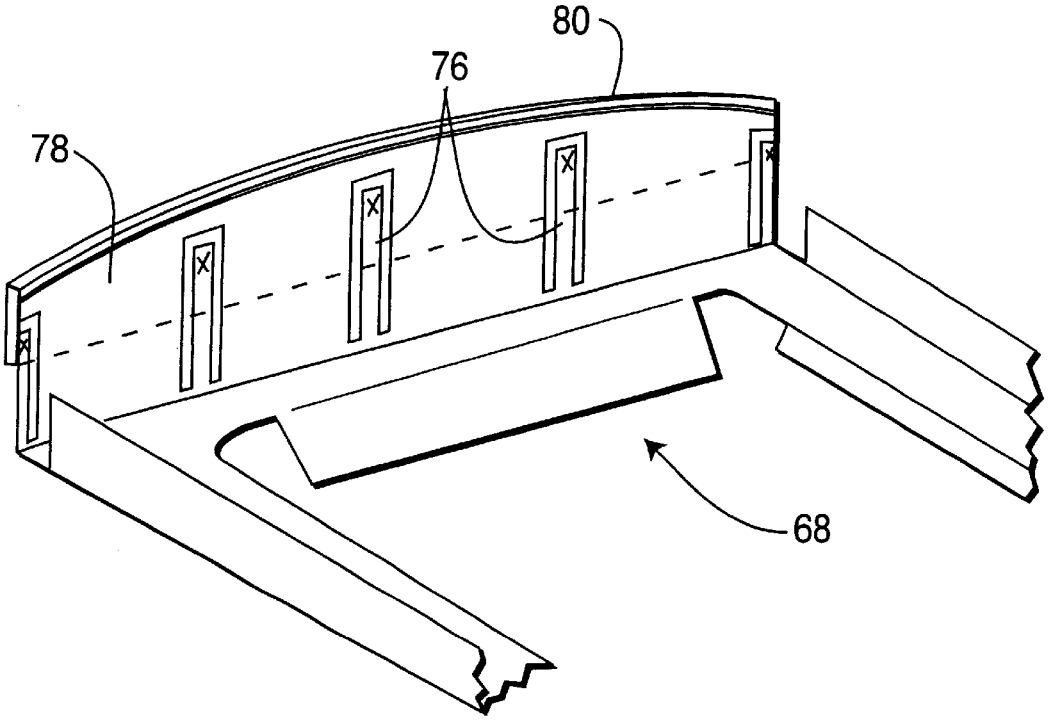
FIG. 9 is a partial perspective view of a fifth frame embodiment.

FIGS. 8 and 9 show two additional frames 66 and 68, respectively. Each of these frames has tabs that are enclosed within unopen cutouts in a flange of the frame. In the frame 66 of FIG. 8, a plurality of tabs 70 extend down from the distal edge of a flange 72, and are attached by welding to an intermediate member 74. In the frame 68 of FIG. 8, a plurality of tabs 76 extend upward toward the distal edge of a flange 78, and are attached by welding to an intermediate member 80.

What is claimed is:

1. A color picture tube having a tension mask supported by a support frame mounted within said tube, including said mask having a significantly lower coefficient of thermal expansion than said frame, intermediate members located between said mask and said frame, said intermediate members being of a material having a coefficient of thermal expansion similar to that of said mask, and said frame having elongated tabs extending therefrom, each of said tabs being attached at one end thereof to the remaining portion of the frame, with the distal ends of at least some of said tabs being welded to said intermediate members.

2. The color picture tube as defined in claim 1, wherein said tabs are adjacent to each other.

3. The color picture tube as defined in claim 1, wherein said tabs are located between parts of the remaining portion of said frame.

4. The color picture tube as defined in claim 1, wherein said mask is made of a nickel iron alloy and said frame is made of steel.

5. The color picture tube as defined in claim 1, wherein said frame includes two long sides and two short sides, said long sides having an L-shaped cross-section formed by two substantially perpendicular flanges, and slits are located in one of said flanges of both of said long sides to form said tabs.

6. The color picture tube as defined in claim 5, wherein the spacing between said slits is varied, forming narrower and wider sections, and the tabs are being the narrower sections.

7. The color picture tube as defined in claim 5, wherein said frame includes an angled portion extending between said two flanges and, in cross-section, forming a triangle therewith, said angled portion including slits that are aligned with the slits on said one flange.

8. The color picture tube as defined in claim 1, wherein said tabs are located within unopen cutouts within said frame.

9. The color picture tube as defined in claim 8, wherein the distal ends of said tabs face a viewing screen of said tube.

10. The color picture tube as defined in claim 8, wherein the distal ends of said tabs face away from a viewing screen of said tube.

11. A color picture tube having a tension mask supported by a support frame mounted within said tube, including said mask having a lower coefficient of thermal expansion than said frame, intermediate members located between said mask and said frame having a coefficient of thermal expansion similar to that of said mask, said intermediate members are fixed to opposing sides of said frame and extend the length of said opposing sides, and each of said opposing sides having a plurality of adjacent tabs extending therefrom, each of said tabs being attached at one end thereof to the remaining portion of the frame, with the distal ends of at least some of said tabs being welded to said intermediate members.

12. The color picture tube as defined in claim 11, wherein the plurality of adjacent tabs is formed from a plurality of slits and adjacent tabs are formed from the same slit.

13. The color picture tube as defined in claim 11, wherein the opposing sides have L-shaped cross-sections formed by two substantially perpendicular flanges, and slits are located in one of said flanges of both of said opposing sides to form said plurality of adjacent tabs.

14. The color picture tube as defined in claim 13, wherein said opposing sides include angled portions extending between said two flanges and, in cross-section, forming a triangle therewith, said angled portion including slits that are aligned with the slits on said one flange.

15. The color picture tube as defined in claim 11, wherein the plurality of adjacent tabs are formed from a plurality of slits and spacing between said slits is varied, forming narrower and wider sections, and the plurality of adjacent tabs are formed from the narrower sections.

16. The color picture tube as defined in claim 11, wherein the plurality of adjacent tabs are located within unopen cutouts within said frame.

17. The color picture tube as defined in claim 11, wherein the distal ends of said tabs face a viewing screen of said tube.

18. The color picture tube as defined in claim 11, wherein the distal ends of said tabs face away from a viewing screen of said tube.

19. The color picture tube as defined in claim 11, wherein said mask is made of a nickel iron alloy and said frame is made of steel.

* * * * *